United States Patent [19]

Franek et al.

[11] 4,423,823

[45] Jan. 3, 1984

[54] CONTAINERS

[75] Inventors: Josef T. Franek, Chorleywood; Paul Porucznik, St. Albans; Peter H. Serby, Newbury; Christopher J. N. Tod, Steyning, all of England

[73] Assignee: Metal Box Limited, Reading, England

[21] Appl. No.: 293,634

[22] PCT Filed: Dec. 5, 1980

[86] PCT No.: PCT/GB80/00210

§ 371 Date: Aug. 10, 1981

§ 102(e) Date: Aug. 10, 1981

[87] PCT Pub. No.: WO81/01695

PCT Pub. Date: Jun. 25, 1981

[30] Foreign Application Priority Data

Dec. 8, 1979 [GB] United Kingdom ..... 7942425

[51] Int. Cl.[3] ..... B65D 25/14

[52] U.S. Cl. ..... 220/77; 156/203; 156/218; 220/80; 413/1; 413/69

[58] Field of Search ..... 220/75, 77, 80; 413/1, 413/69; 156/69, 293, 203, 218, 466

[56] References Cited

U.S. PATENT DOCUMENTS

| | | | |
|---|---|---|---|
| 3,036,728 | 5/1962 | Gibb | 220/80 |
| 3,618,817 | 11/1971 | Troughton | 220/77 |
| 3,669,816 | 6/1972 | Smith et al. | 220/80 |
| 3,898,945 | 8/1975 | Rohowetz | 413/1 |
| 3,906,126 | 9/1975 | Kaiser | 220/75 |
| 3,921,847 | 11/1975 | Rentmeester | 413/1 |
| 4,003,492 | 1/1977 | Beveridge | 220/77 |
| 4,034,132 | 7/1977 | Manuel | 220/75 |
| 4,065,023 | 12/1977 | Rentmeester | 413/1 |
| 4,293,353 | 10/1981 | Pelton | 220/461 |

FOREIGN PATENT DOCUMENTS

| | | | |
|---|---|---|---|
| 56-84247 | 4/1979 | Japan | 413/77 |

*Primary Examiner*—Leon Gilden

*Attorney, Agent, or Firm*—Diller, Ramik & Wight

[57] ABSTRACT

In a metal container having at least one seam by which two overlapping metal edges are joined together, at least one of the edges (58) has a resilient polymeric layer (56) bonded firmly to the metal, so that when that edge (58) is seamed to a second edge (60) the polymeric layer deforms without destroying the bond, and becomes bonded to the second edge, so creating a seal against leakage. A layer of latex no greater than 0.10 mm thick may optionally be included. Seams to which the invention is applicable include swaged seams, interlocked double seams or longitudinal side seams. In the latter case the polymeric layer may provide the bond to secure a single lap seam.

12 Claims, 17 Drawing Figures

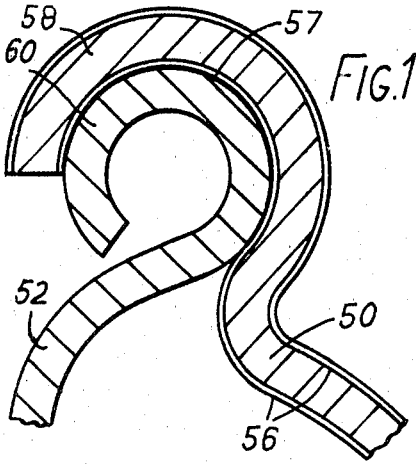
FIG.12
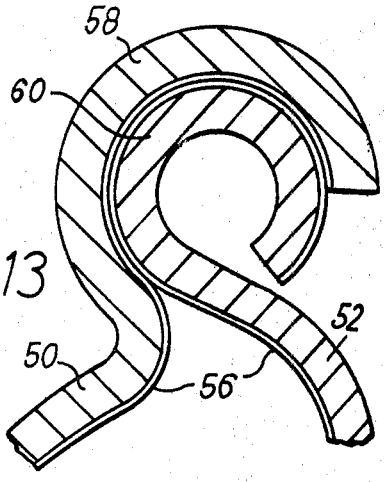
FIG.13
FIG.14
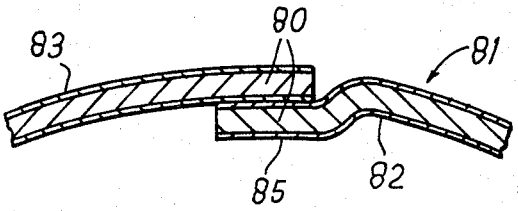
FIG.15
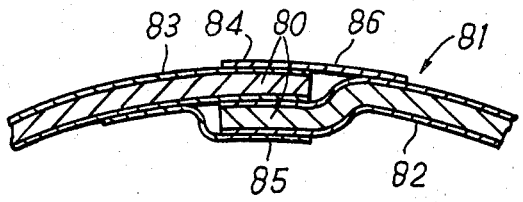
FIG.16
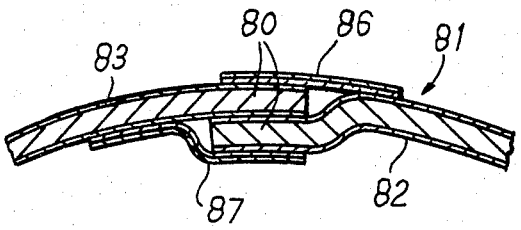
FIG.17
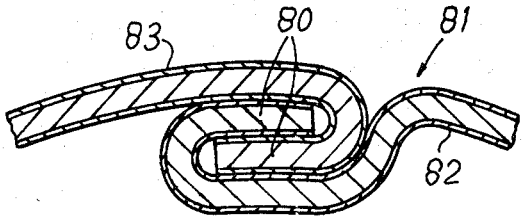

CONTAINERS

TECHNICAL FIELD

This invention relates to containers of the kind having a plurality of components at least one of which is of laminar metallic material, the container having at least one seam securing an edge portion of a said laminar metallic component to an overlapping edge portion of a component of the container. Such a container will be called herein "a container of the kind specified". Examples of such seams are the double seam by which a metal can end member is seamed to a metal can body; the swaged seam whereby the valve cup of an aerosol dispensing container (hereinafter referred to as an aerosol can) is seamed to the remainder of the container; and a longitudinal side seam of a built-up metal can body.

BACKGROUND ART

One example of a container of the kind specified is a can of the so-called "open-top" kind, i.e. a can comprising a can body which by itself has an open top end, but which has this end closed by a can end member secured to the can body by means of a peripheral double seam. Another example is an aerosol can in which the top end of the cylindrical can body is closed by a domed or generally cone-shaped cover member having an aperture which is itself closed by a cup carrying the aerosol dispensing valve. The cup is usually swaged on to the cover member. In the case of the aerosol can, this invention may also provide benefits in the joint between the cover member and the can body.

As far as open-top cans are concerned, it has for many years been conventional practice to stamp a can end member from a sheet of metal which has been pre-lacquered for subsequent protection of the metal, or of the eventual contents of the can, or both, and to apply a suitable sealing compound to a peripheral flange of the can end member. Following this, the end member is positioned over an open end of the sheet metal can body, which is also pre-lacquered, with the peripheral flange of the end member overlying a peripheral flange of the body. The two flanges are then deformed together to produce a double seam.

This process has a number of disadvantages. Firstly, during the seaming operation there is a danger that the lacquer may be damaged on either the can end member or the can body as a result of local high pressure between the end member and the body, or friction between one of these parts and the seaming tools. If the lacquer is damaged there follows a risk of corrosion of the metal and of contamination of the contents of the can. Another problem is that the sealing compound is occasionally squeezed out during formation of the double seam and this again may have a detrimental effect on the quality of the seal provided by the seam and on the eventual contents of the can.

Turning to aerosol cans, the same problems may also occur when the cover member is joined to the can body. Both of these parts may be lacquered prior to being joined together, and, as in the case of an open top can end member, a peripheral flange of the aerosol can cover member is lined with a suitable sealing compound. In this case, if the lacquer on an internal surface is damaged whilst the cover member is being secured to the can body, there is a considerable risk of internal rusting if the aerosol formulation to be contained by the can includes water. Additionally, if sealing compound is squeezed into the interior of the can body whilst the cover member is being secured to the latter, and particles of the compound become dislodged, they may eventually, in use, block the aerosol dispensing valve.

Similar problems may occur when the cup is swaged on to the cover member. The cup normally has a peripheral flange carrying a sealing compound.

The sealing compound is typically a gasket of a suitable latex preparation, which is applied by "flowing-in". For example, the gasket on the valve cup of an aerosol can is typically applied as a water-based suspension in sufficient quantities to give a final dry weight of 570 mg., corresponding to a dry thickness which at the thickest cross-section of the gasket is in the approximate range 0.50 to 0.65 mm. Apart from the problem, mentioned above, of pieces of the gasket possibly breaking off and falling into the contents of the container, this relatively great thickness of gasket material (lining compound) has another disadvantage. Although it is technically feasible to allow the wet latex suspension to dry naturally at ambient temperature, the storage time involved would be economically unacceptable. It is therefore necessary to accelerate drying, and to this end the provision of ovens is required. This, although cheaper than natural drying, is still very costly in terms of capital cost, maintenance cost, energy consumption and space requirements.

There has for some time, unconnected with the problems discussed above, been considerable interest in laminated materials. These are being developed primarily to give them resistance to the temperatures employed in the "processing" (e.g. pasteurising) of foodstuffs or beverages packed in cans, as an alternative to the use of a tin coating, since the cost of this coating is becoming more and more expensive. The laminates concerned comprise a thin polymeric layer overlaid upon a metallic substrate. The base material used for laminating is typically "tin-free steel", or alternatively blackplate. Out of many possible polymer films tested, polypropylene appears promising for the packaging industry, due to its low cost, fusibility (faces can be heat sealed to each other), low extractability and ability to withstand processing temperatures. The back of the film may be printed prior to lamination, thus protecting the printing inks. Also, boxes such as biscuit boxes and the like may be completed by heat fusing at the joints after being folded.

Such laminates are quite well documented in the prior art, for the purposes mainly of providing a temporary surface having a low friction in order to facilitate working of the metal, or of rendering a tin coating on tinplate unnecessary having regard to the increasing cost of metallic tin. In pursuit of the former aim, many proposals have been made for polymeric coatings which are removed after the container has been made. Thus for example, United Kingdom Pat. Nos. 623,073 and 866,266 disclose removable coatings of vinyl polymers or co-polymers. Other proposals have been made whereby can bodies or end members of the so-called "easy-opening" kind are of metal having a polymeric or ionomeric coating which may typically be of a polyolefin such as polypropylene, adhered to the metal substrate by an adhesive.

THE INVENTION

This invention proposes a container of the kind specified, in which the problems found in relation to lacquer damage and the use of relatively thick sealing gaskets are substantially reduced or eliminated.

According to the invention in a first aspect, in a container of the kind specified, at least one of the metallic components of the container has, bonded to the metal over at least the surface of the edge portion thereof which faces another edge portion overlapping it in a said seam, a layer of resilient polymeric material which is sealingly compressed between the overlapping edge portions.

By virtue of its resilience and bond with the underlying metal, the polymeric material provides a firm seal at the join between the two parts and, even when squeezed, exhibits negligible tendency for particles thereof to become dislodged into the container. This is an improvement over the sealing compound mentioned above, which may either be omitted entirely or, if provided, need be present only in the form of a very much thinner layer than has been necessary heretofore. In addition, for most purposes the use of a flowed-in sealing gasket is rendered unnecessary. If desired for any reason, such a gasket may however be applied in the seam in addition to the polymeric layer, but in such as case it is of very much reduced thickness, viz. no thicker than 0.10 mm. Such a thin gasket may normally be economically dried at ambient temperature, thus eliminating the need for a drying oven; though even if an oven is used, the drying time is reduced by a significant amount, representing a substantial saving in energy costs.

One possible application of the invention is to an open-top or aerosol can, where seams formed using the polymeric layer may comprise interlocked double seams whereby one or two can end members are secured to the can body, or a longitudinal side seam of the can body. Another possible application is in the swaged seam whereby a valve cup is secured to the cover member of an aerosol can.

Where the invention is employed in respect of the side seam of can body, this seam may be of an interlocked kind, or alternatively it may be a simple lap seam in which the overlapping edge portions of the can body are bonded together by the polymeric layer itself.

According to the invention in a second aspect, a method of making a container of the kind specified includes the steps of locating, in overlapping relationship with an edge portion of a component of the container, an edge portion of a said laminar metallic component having bonded to the metal over at least the surface of the edge portion facing the edge portion with which it overlaps, a layer of resilient polymeric material; and urging the edge portions together so as to compress the polymeric layer between them and to form a seam sealed thereby.

Preferably, at least the edge portion having a polymeric layer is heated to a temperature such as to soften the polymeric layer without destroying the bond between it and the associated metal.

The polymeric layer may be of any one of a number of polymeric materials, including polyesters and polypropylene. Cast polypropylene provides a good barrier against the passage of water and resists attack by acids, oil and greases. Polypropylene may thus prove capable of withstanding the environment present both internally and externally of food cans, beverage cans, aerosols and many other containers. As a result, in containers for most products, the surface or surfaces covered by a cast polypropylene layer need not be pre-lacquered. Thus, of two of the manufacturing operations normally required in the production of the aerosol container, viz. (a) the application of sealing compound or an equivalent and (b) the pre-lacquering of at least one of the surfaces to be joined, may be omitted with resultant saving in cost. Furthermore, cast polypropylene, being resilient, unlike conventional lacquers, is highly resistant to damage during the deformation of the two parts which takes place whilst they are being joined together.

Another advantage of the use of polypropylene for the polymeric layer is that it is heat sealable, so that, if the surfaces to be joined are heated so that they are hot whilst being joined together, a further improved seal may be achieved.

Embodiments of the invention will now be described, by way of example only, with reference to the diagrammatic drawings of this application briefly described below.

BRIEF DESCRIPTION OF THE DRAWINGS

FIGS. 12 and 13 are fragmentary sections through the seam joining the valve cup and cover member of two embodiments of aerosol can produced by the operation illustrated in FIGS. 9 to 11; and FIGS. 14 to 17 are cross-sections through longitudinal side seams of a can body illustrating four respective further embodiments of the invention.

BEST MODE OF CARRYING OUT THE INVENTION

Figure 1:
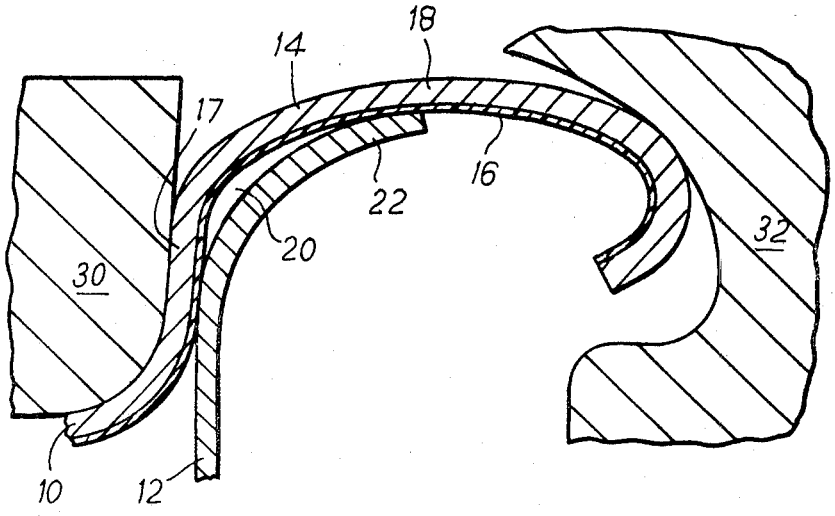
FIGS. 1 to 4 illustrate four stages in the operation of securing a can end member to a can body by means of a double seam, during manufacture of a can embodying the invention.

FIG. 1 shows a fragment of a can end member 10 about to be secured to a cylindrical can body 12. The member 10 can be an end member for closing either the top or the bottom of the body 12. The body 12 may be a body for an open-top can or for an aerosol can. In the latter case the member 10 is a cover member, domed or generally cone-shaped, having an aperture (not shown) for securing a valve cup (not shown) thereto. The end member 10 is formed from sheet metal 14 which in this example is the commercially-available material known as tin-free steel. Bonded, by adhesive or otherwise, to the whole of one surface of the metal 14 is a resilient covering layer 16 of cost polypropylene. The other surface of the metal is lacquered. The end member 10 has a chuck wall 17 terminating in a peripheral end curl or flange 18. The chuck wall 17 lies within the open end 20 of the can body 12 so that the flange 18 overlies a peripheral flange 22 of the body 12 with the layer 16 in contact with the body flange 22. The body 12 is also formed from sheet metal, for example tin-free steel that has been pre-lacquered.

Figure 2:
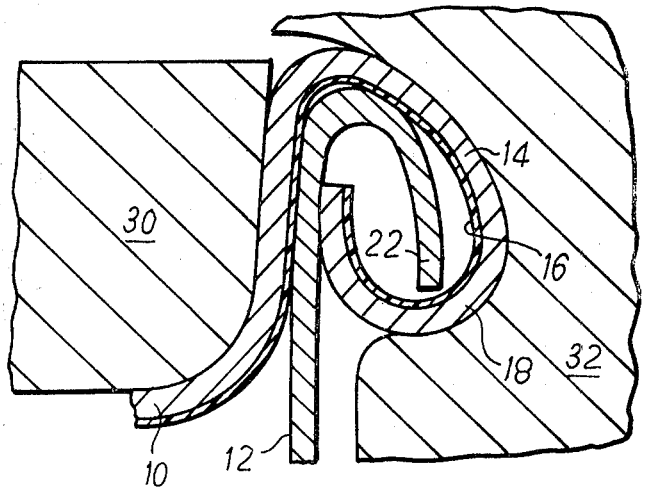
Figure 3:
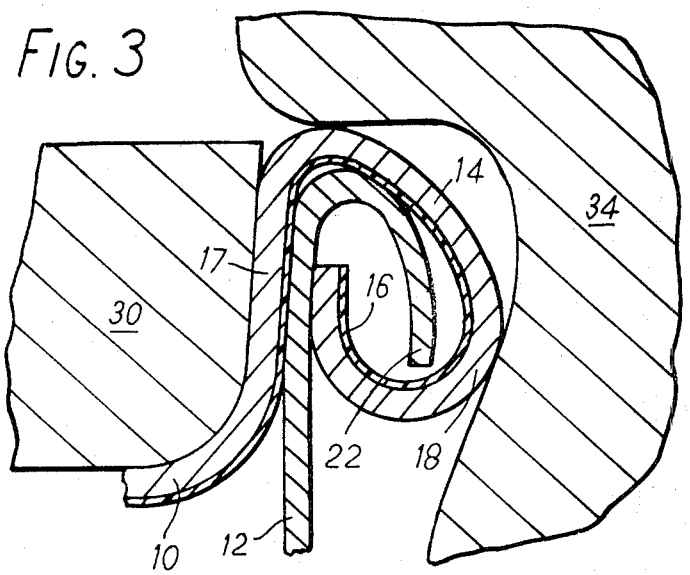

In order to join the end member 10 and the body 12 together, a central, coaxial chuck 30 and an external, first-operation seaming roll 32 are used in a conventional manner. The chuck 30 engages the chuck wall 17 to locate it in position in the body 12, and the roll 32 engages the end flange 18, firstly as shown in FIG. 1 and subsequently as shown in FIG. 2, to curl together the end flange 18 and body flange 22. The roll 32 is then withdrawn and a second-operation seaming roll 34 is advanced into engagement with the end flange 18, as shown in FIGS. 3 and 4, to flatten the partly-formed seam and thus produce the completed double seam illustrated diagrammatically in FIG. 4 and more accurately in FIG. 5.

Figure 4:
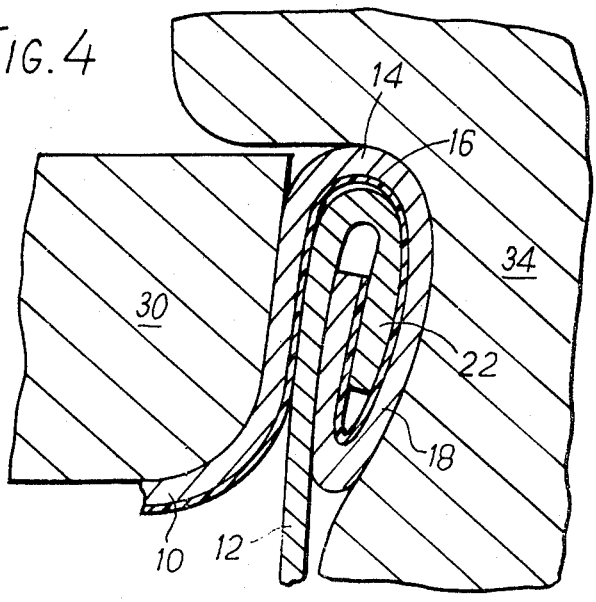
Figure 5:
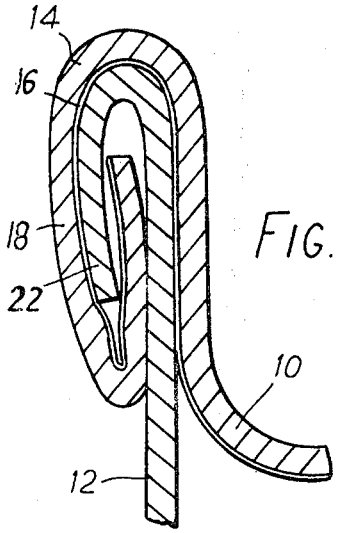
FIG. 5 is a fragmentary section through the double seam produced by the operation illustrated in FIGS. 1 to 4.

It will be evident from FIGS. 4 and 5 that, at the end of the seaming operation, the polymeric layer 16 is compressed between the metal of the end flange 18 and that of the body flange 22, to provide a seal between the end 10 and the body 12. During the seaming operation described above with reference to FIGS. 1 to 4, the substantial forces exerted on the chuck wall 17 and on the flanges 18 and 22 by the seaming tools 30,32,34, give rise to very high hoop stresses and shear stresses at the interfaces between the two components 10 and 12. These stresses are absorbed largely or entirely by the polymeric layer 16 which is able to undergo substantial strain whilst remaiing bonded to the metal surface of the end member 10. At the same time, the yielding layer 16 exerts low friction on the lacquer provided on the surface of the body 12 with which it is in contact, so minimising or preventing damage to the lacquer. The maintenance of the mechanical bond between the polymeric layer and the corresponding metal surface is an important feature, since it minimises or prevents the detachment of pieces of polymer which might fall into the container. Furthermore, the layer 16 protects the underlying metal of the end member 10 during the useful life of the can.

Figure 6:
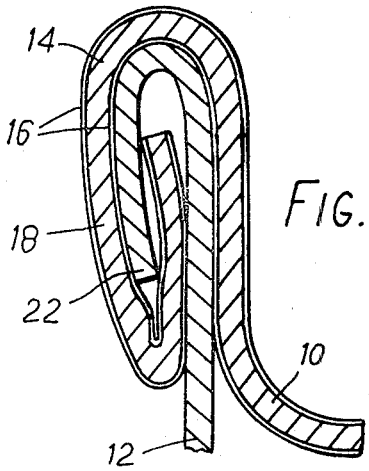
FIGS. 6 to 8 are similar sections to that of FIG. 5, and illustrate three respective modifications.
Figure 7:
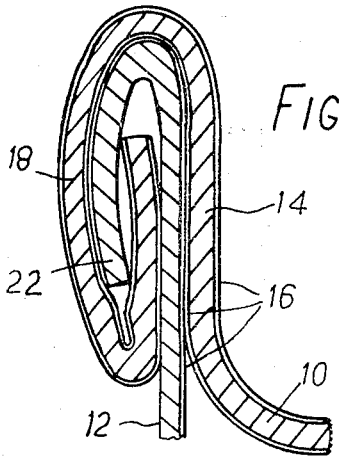
Figure 8:
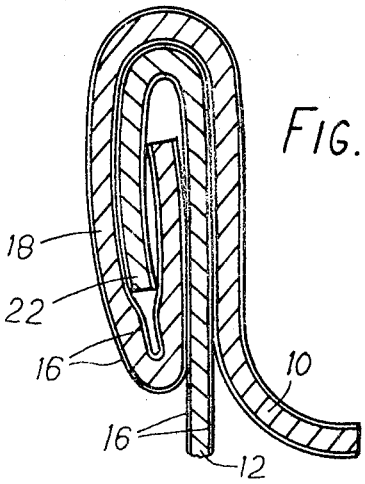

FIGS. 6, 7 and 8 show the double seam of three respective cans similar to the one illustrated in FIG. 5, except that, in FIG. 6, both surfaces of the end member 10; in FIG. 7 both surfaces of the end member 10 and one surface of the body 12; and in FIG. 8 both surfaces of the end member 10 and both surfaces of the body 12, have resilient polymeric layers 16 bonded to the metal of the respective components 10,12. In each case may metal surface not having an overlying layer 16 is lacquered in conventional manner. In the arrangements shown in FIGS. 7 and 8 where two polymeric layers 16 are forced into contact with each other, the stresses set up at their mutual interface will tend to weld the two polymeric layers together. Other variations are possible as well. For example, the interior surface only of the body may be provided with a cast polypropylene layer 16.

Figure 9:
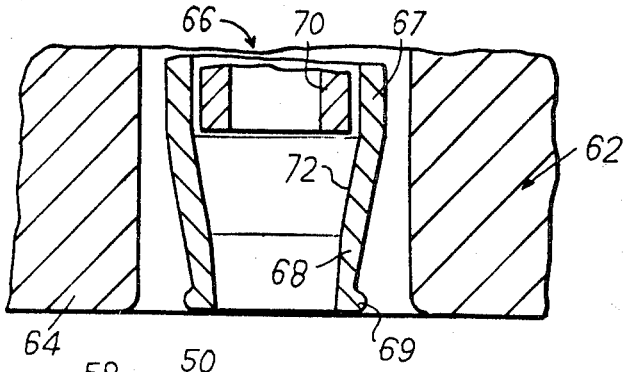
FIGS. 9 to 11 illustrate three successive stages in a swaging operation for joining a valve cup to a cover member of an aerosol can, during manufacture of an aerosol can embodying the invention.
Figure 9:
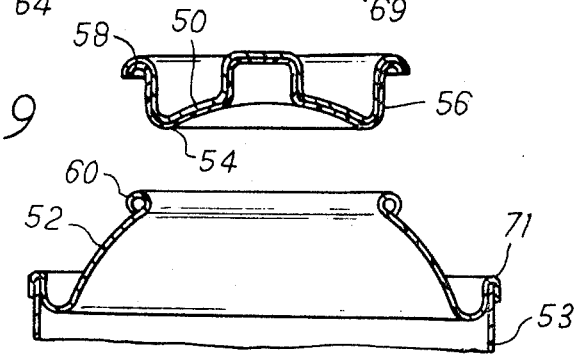
Figure 10:
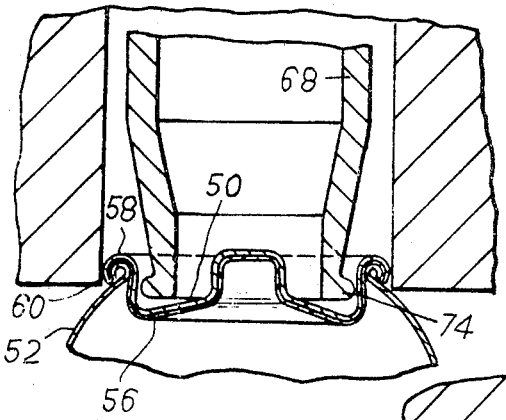
Figure 11:
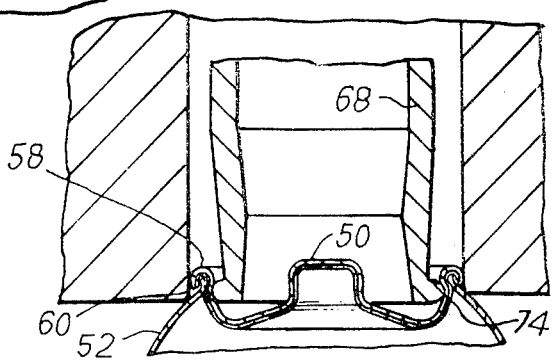

In the process illustrated in FIGS. 9, 10 and 11, a valve cup 50 is swaged to a domed cover member 52 of an aerosol can having a body 53. The valve cup 50 is formed from sheet metal, for example tin-free steel, and its undersurface 54 has, bonded to the metal, a layer 56 of cast polypropylene. The layer 56 is shown of exaggerated thickness in FIG. 9 and is not shown in FIGS. 10 and 11. The cup 50 has a peripheral curl or cup flange 58 whose underneath surface (over which the layer 56 extends) is arranged to overlie a curled peripheral cover flange 60 which defines the central aperture of the cover member 52 (see FIG. 10). The surfaces of the two components 50 and 52 not having the polymeric layer 56 are pre-lacquered.

In order to secure the cup 50 and cover member 52 together, a conventional swaging head 62 is used. The head 62 comprises a tool 66 coaxially disposed within a locating ring 64. The latter is arranged to engage around the cup flange 58 and to press it against the cover flange 60, thus compressing the polymeric layer 56. The tool 66 comprises a collet 67 having resilient segmented chives or fingers 68, and a mandrel 70 movable axially downwards to urge the fingers 68 radially outwardly by engagement with a sloping shoulder 72 on the back of each finger, and axially upwards to allow them to retract resiliently to their normal position shown in FIG. 9. Each finger 68 has an external cup-engaging portion 69.

In operation, the locating ring 64 is moved into engagement with the cup flange 58, to urge it into close contact with the cover flange 60. The collet 67 is then moved downwardly to the position shown in FIG. 10, until the cup-engaging portions 69 are level with the outer wall, 74, of the cup 50 below the cup flange 58. Finally the mandrel 70 is moved downwardly to force the fingers 68 radially outwardly into engagement with the cup wall 74 as shown in FIG. 11; the cup wall 74 is thus deformed outwardly to engage behind the body flange 60 and secure the cup 50 to the cover member 52.

If desired, after the fingers 68 have been radially extended once, they may be retracted to withdraw them from engagement with the cup 50, the cup 50 then being rotated relative to the fingers 68, and the latter then being expanded radially once again, to perform a second swaging operation. This may be repeated again, as many times as may be desired, preferably with rotation of the cup 50 and cover member 52 between each swaging operation and the next. This ensures that the cup wall 74 is deformed outwardly to engage behind the cover flange 60 along its entire circumference rather than merely along a major proportion of its circumference. Multiple swaging (i.e. performing more than one swaging operation as described above) naturally tends to create a better seal though an adequate seal is possible with a properly-conducted single swaging operation.

As with the open-top can closing operation described with reference to FIGS. 1 to 5, a seal is produced between the valve cup 50 and the cover member 52, the resilient polypropylene layer 56 protecting both the metal of the cup 50 and the lacquer and metal of the cover member 52, both during and after swaging.

Referring now to FIGS. 12 and 13, two respective modifications of the aerosol can shown in FIG. 11 are there illustrated, and may be produced by either single or multiple swaging operations as desired. In the arrangement shown in FIG. 12, both surfaces of the sheet metal of the valve cup 50 are provided with a polypropylene layer 56; whilst in FIG. 13, the underneath surface of the cup 50 and the interior surface of the cover member 52 have a layer 56. In each instance the layers 56 are securely bonded to the underlying metal. Other variations are, of course, also possible so long as the metal of the two components 50,52 is separated in the regions of the flanges 58,60 by at least one polymeric layer.

In all of the embodiments described above, heat may be applied to the joint between the two flanges to enhance sealing. This heat may be applied either immediately before, or during, the swaging operation so that at least the flanges 58 and 60 are hot during at least that part of the operation shown in FIG. 11, in which the actual swaging action takes place. Alternatively, heat may be applied afterwards, for example in a separate operation at a different station of the apparatus. The purpose of such heating is to soften the cast polypropylene of the layer or layers 56, though not to such an extent that the mechanical bond between the polypropylene and the metal will be impaired. Heat may be applied in any known manner, for example by providing an electric heating element in the locating ring 64, or by direct gas heating, or by induction heating.

Referring now to FIGS. 14 to 17, the invention may be applied to the joining together of a pair of edge portions which are substantially flat, as are the edge portions 80 of the cylindrical can body 81 shown in these Figures. As shown, these edge portions 80 are overlapped to form a side seam of the can body.

In each of the cases shown, the can body has a polypropylene layer 82 bonded to the metal on its inside surface. There is also shown a further and similar (but optional) layer 83 bonded on the outside surface of the metal. FIGS. 14 to 16 show simple lap seams in which the two edge portions 80 are joined by application of simple pressure to force them together, the polypropylene between them being allowed to yield in the process and to establish a firm, sealing bond between the two edge portions 80. Heat, preferably applied by induction heating, is employed as described above so that the edge portions are hot whilst being pressed together to form the seam.

In FIG. 15 a strip of polymer film 84 is applied subsequently along the outside, and a similar strip 85 along the inside, of the seam to provide additional protection against leakage. In FIG. 16 the film strips 84,85 are replaced by strips of laminated aluminium foil 86,87 respectively, for the same purpose.

FIG. 17 shows a can side seam in the interlocked form of a double seam, which is formed in conventional manner.

Further modifications, which may be made in respect of the arrangements described above, within the scope of the invention, are as follows.

There may be provided a film of a can lacquer between any polymeric layer and the metal substrate which it overlies. The resilient polymeric layer provides protection in the event of any discontinuities in the lacquer due, for example, to working of the metal where the lacquer has any tendency to brittleness.

A further modification is to apply, over one of the edge portions to be joined in a seam, a thin film of a latex preparation of any suitable kind having air-drying characteristics. Thus, for example, such a thin latex film is indicated at 57 in FIG. 12. The film is applied just before the valve cup 50 and cover member 52 are presented to the tool 62, and is overlaid either upon the curl 60 of the cover member, or upon the polymeric layer 56 within the channel of the curl 58 of the valve cup. When th swaged seam is formed, the latex film 57 is squeezed resiliently together with the polymeric layer 56 to form, additionally to the latter, a seal between the cup 50 and cover member 52.

The latex film 57 may be provided within the seams of any of the other embodiments described, though it is particularly applicable to containers likely to hold products which could cause swelling of the polypropylene layer. Examples of such products are those having an alcohol as solvent, or aerosol preparations including certain fluorocarbon propellants.

If provided, the latex film is, in the conventional notation used in the art, of a final dry weight of no greater than 100 mg; that is to say at its thickest section the thickness of the latex film is no greater than about 0.10 mm, and will typically be in the range 0.07 to 0.10 mm.

The choice of metal for each of the components to be secured to each other, or, as in the case of FIGS. 14 to 17, the single component to be joined to itself, in a method according to the invention is between metals to which the polymeric layer can be satisfactorily bonded. Although in the examples described the metal is "tin-free steel", either tin-plated steel (tinplate) or blackplate may for example be used instead. The cast polypropylene layer preferably has a thickness of between 10 and 100 micrometers. On tinplate it may for example have a thickness of about 0.07 mm, whilst similar sealing qualities may be obtained with a layer of about 0.02 mm thickness or tin-free steel. The film may have been bonded to the underlying metal by, for example, adhesion using a cross-linkable urethane type adhesive. Alternatively, it may have been extruded on to the metal, the latter having been previously primed with a suitable priming compound. In another alternative method the polypropylene is applied to the metal in powder form by electrostatic deposition and subsequently melted in known manner. In each case, however, the polymeric layer must be firmly bonded to the metal.

The methods described above are not restricted to securing can end members to open-top can bodies or to securing the valve cup of an aerosol can to the cover member. It may for example be used to form the double seam 71 (FIG. 9) securing the cover member 52 to the aerosol can body 53, in which case either the former or the latter or both will be provided with at least an internal polymeric layer 56, for example as shown in FIG. 13.

We claim:

1. A metal can comprising a plurality of steel components having overlapping edge portions secured to each other in a seam, characterised in that at least one of the components is made from sheet comprising a laminate of steel with polypropylene, the latter being cast coextensively over at least one side of the steel to a thickness in the range 0.01 to 0.10 mm, at least one said polypropylene layer of the overlapping edge portions in said seam being disposed between the steel layer of said edge portions, and said steel layers being securely and substantially permanently bonded together solely by means of the said cast polypropylene between them and without any adhesive layer in the seam.

2. A can according to claim 1 characterised in that at least one of its components is of tin-free steel laminated with cast polypropylene whose thickness is substantially 0.02 mm.

3. A can according to claim 1 characterised in that at least one of its components is of tinplate laminated with cast polypropylene whose thickness is substantially 0.07 mm.

4. A can according to claim 1 characterised by a said seam in which the overlapping edge portions are in un-interlocked relationship.

5. A can according to claims 1 or 4 being an aerosol can comprising a can body having a cover member secured thereon, the cover member having an aperture closed by a valve cup which is secured to the cover member by a swaged seam comprising overlapping flanges of the valve cup and cover member, characterised in that at least the valve cup is made of the said laminated material, the polypropylene layer thereof extending within and bonding the swaged seam.

6. A method of making a metal can comprising a plurality of steel components having overlapping portions secured to each other in a seam, characterised by making at least one of said components from sheet comprising a laminate of steel with polypropylene, the latter being cast co-extensively over at least one side of the steel to a thickness in the range of 0.01 to 0.10 mm, and by forming the or each said seam by the steps of: locating an edge portion of a laminated component in overlapping relationship with another edge portion of a component, with said polypropylene of at least one of the edge portions facing the other edge portion: urging the edge portions together to compress the polypropylene between them: and applying heat to soften the polypropylene without destroying the bond between it and its associated steel layer, whereby the polypropylene, on subsequent cooling, alone and without any additional adhesive, forms a secure and substantially permanent bond holding the steel layers of the edge portions together.

7. A method according to claim 6, characterised in that the edge portions are urged together by interlocking them to form a hooked seam.

8. A method according to claim 6, characterised in that the edge portions, being of curled form, are urged together by swaging.

9. A method according to claim 6, characterised in that the edge portions, being substantially flat, are urged together by simply lateral pressing, so that they become bonded together in non-interlocking relationship by the polypropylene layer between them.

10. A method according to any one of claims 6, 7, 8 and 9 characterised in that the edge portions are urged together whilst hot.

11. A method according to any one of claims 6, 7, 8 and 9 characterised in that the heat is applied after the edge portions have been seamed together.

12. A metal can comprising a plurality of steel components having overlapping portions secured to each other in a seam, at least one of said components being a sheet comprising a laminate of steel with polypropylene, and the latter being cast co-extensively over at least one side of the steel to a thickness in the range 0.01 to 0.10 mm, an edge portion of a laminated component being located in overlapping relationship with another edge portion of a component, with said polypropylene of at least one of the edge portions facing the other edge portion: the edge portions being compressed together thereby to compress the polypropylene between them: the polypropylene being heated without destroying the bond between it and its associated steel layer, whereby the cooled polypropylene alone and without any additional adhesive forms a secure and substantially permanent bond holding the steel layers of the edge portions together.

* * * * *